US005515152A

United States Patent [19]

Kuo

[11] Patent Number: 5,515,152

[45] Date of Patent: May 7, 1996

[54] MULTI-GATE TANDEM DECURLER

[75] Inventor: Youti Kuo, Penfield, N.Y.

[73] Assignee: Xerox Corporation, Stamford, Conn.

[21] Appl. No.: 317,154

[22] Filed: Oct. 3, 1994

[51] Int. Cl.[6] ..... G03G 21/00

[52] U.S. Cl. ..... 355/309; 162/271

[58] Field of Search ..... 355/308, 309, 355/311, 319, 321; 162/270, 271

[56] References Cited

U.S. PATENT DOCUMENTS

| | | | |
|---|---|---|---|
| 4,077,519 | 3/1978 | Huber | 209/643 |
| 4,326,915 | 4/1982 | Mutschler, Jr. | 162/271 |
| 4,360,356 | 11/1982 | Hall | 493/459 |
| 4,475,896 | 10/1984 | Bains | 493/454 |
| 4,591,259 | 5/1986 | Kuo et al. | 162/271 X |
| 4,632,533 | 12/1986 | Young | 355/309 |
| 4,926,358 | 5/1990 | Tani et al. | 355/311 X |
| 4,977,432 | 12/1990 | Coombs et al. | 355/309 |
| 5,066,984 | 11/1991 | Coombs | 355/309 |
| 5,084,731 | 1/1992 | Baruch | 162/271 X |
| 5,099,269 | 3/1992 | Johdai et al. | 355/24 |
| 5,287,157 | 2/1994 | Miyazato et al. | 355/309 |

*Primary Examiner*—Robert Beatty
*Attorney, Agent, or Firm*—William A. Henry, II

[57] ABSTRACT

A decurler apparatus in a machine changes sheet bending direction away from image (AI) to toward image (TI) direction by use of tandem gates and bending baffles to direct copy papers to different decurling paths to reduce copy curl. A controller automatically determines the optimum decurling path for an individual copy paper according to sensor inputs derived from the paper basis weight, color layers, image area coverage and relative humidity. An operator control feature is included that allows operators to reduce output curl of out-of-specification papers through push-buttons on a machine control panel.

14 Claims, 4 Drawing Sheets

MULTI-GATE TANDEM DECURLER

BACKGROUND OF THE INVENTION

This invention relates generally to a printing unit or processor, such as, an office copier, facsimile or non-impact printer, and more particularly concerns a multi-gate tandem decurler apparatus for decurling sheet material employed in such machines.

Generally, electrophotographic printing comprises charging a photoconductive member to a substantially uniform potential so as to sensitize the surface thereof. The charged portion of the photoconductive surface is exposed to a light image of the original document being reproduced. This records an electrostatic latent image on the photoconductive member which corresponds to the informational areas contained within the original document being reproduced. This records an electrostatic latent image on the photoconductive member which corresponds to the informational areas contained within the original document. The latent image is developed by bringing a developer material into contact therewith. In this way, a powder image is formed on the photoconductive member which is subsequently transferred to a sheet of support material. The sheet of support material is then heated to permanently affix the powder image thereto.

As the sheet of support material passes through the various processing stations in the electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes problems of handling as the sheet is processed in the printing machine. Sheets delivered in a curled condition have a tendency to have their edges out of registration with the aligning mechanisms employed in the printing machine. In addition, curled sheets tend to produce jams or misfeeds within the printing machine. In the past, this problem has been resolved by utilizing bars, rollers or cylinders which engage the sheet material as it passes through the printing machine. Frequently, belts or soft rollers are used in conjunction with a hard penetrating roll to remove the curl in a sheet. However, systems of this type have disadvantages. For example, the size of the decurler is not necessarily consistent with that required in some electrophotographic printing machines. In addition, decurlers of this type generally have a high running torque necessitating significant power inputs to operate successfully. Moreover, on many occasions, in electrophotographic printing, devices previously employed smeared the powder image. Also, a conventional decurler, which most often is of the belt/pinch roll type, has a single paper path, although multiple bending can be set along the paper path, the single path is only effective in reducing paper curls that are primarily in one direction; it is not effective in reducing large curl in the other direction. In other words, if a conventional decurler is designed for flattening dominant TI (toward-image) curls, it would not be able to reduce large AI (away-from-image) curls significantly, and vice versa. For this reason, a single path decurler would fail to decurl thin papers as they exhibit both strong AI and TI curls (depending on which side is on the hot fuser roll) at high moisture content. Further, in a color copier, heavily imaged multi-color copies exhibit strong toward-image (TI) curl as oppose to the away-from-image (AI) curl of a plain or lightly imaged copy sheet. Without decurling treatments, these curled copies may cause image quality and paper handling problems that are unacceptable to customers.

Various approaches have been devised to improve sheet decurlers to answer the above-detailed problems. The following disclosures appear relevant:

- U.S. Pat. No. 4,077,519; Patentee: Huber; issued Mar. 7, 1978.
- U.S. Pat. No. 4,326,915; Patentee: Mutschler, Jr.; issued Apr. 27, 1982.
- U.S. Pat. No. 4,360,356; Patentee: Hall; issued Nov. 23, 1982.
- U.S. Pat. No. 4,475,896; Patentee: Bains; issued Oct. 9, 1984.
- U.S. Pat. No. 4,977,432; Patentee: Coombs et al.; issued Dec. 11, 1990.
- U.S. Pat. No. 5,066,984; Patentee: Coombs; issued Nov. 19, 1991.

The pertinent portions of the foregoing disclosures may be summarized as follows:

Huber describes a curl detector and separator wherein a paper sheet is passed through the nip of a rotating roll and charging roll, and thereafter the sheet is stripped from the rotating roll by a vacuum stripper which allows the sheet to pass between the nip of a subsequent transport roll pair.

Mutschler, Jr. discloses a sheet decurler apparatus wherein a sheet is pressed into contact with a rigid arcuate member in at least two regions. The sheet moves about the arcuate member or rod in a curved path to remove curl in the sheet. The sheet is bent in one direction by a first rod and in another direction by a second rod.

Hall discloses an apparatus for removing curl from continuous web material during its travel through engagement bars that can be adjusted to remove AI or TI curl.

Bains describes a curling/decurling mechanism that combines a compliant roller with a soft outer layer in a curling roller to form a penetration nip with the compliant roller. Movable parts are employed to control the angle of sheets as they exit from the nip.

Coombs et al. is directed to a decurling device that includes an arcuate concave guide and a feed roll which causes paper to pass between the guide and the feed roll to decurl the paper. A means is included for selectively laterally offsetting paper driven through the device.

Coombs describes a decurling device that includes an arcuate concave guide and a feed roll which causes paper to pass between the guide and the feed roll to decurl the paper. The space between the guide and the roll is greater than the thickness of the paper and the paper is bent in the direction opposite to its curl as it passes through the arched space.

The present invention aims at providing a multi-gate decurler designed with the capability of bending sheets in both toward image (TI) and away from image (AI) directions. The bending level in either direction can be adjusted automatically to flatten different levels of incoming sheet curl with different properties.

SUMMARY OF THE INVENTION

Accordingly, the present invention provides a decurler apparatus that changes sheet bending direction from AI to TI direction by use of tandem gates and bending baffles to direct copy papers to different decurling paths to reduce copy curl. A software control program automatically determines the optimum decurling path for an individual copy paper according to sensor inputs derived from the paper basis weight, color layers, image area coverage and relative humidity. An operator control feature is included that allows machine operators to reduce output curl of out-of-specification papers through push-buttons on a machine control panel.

BRIEF DESCRIPTION OF THE DRAWINGS

The foregoing and other features of the instant invention will be apparent from a further reading of the specification, claims and from the drawings in which:

All references cited in this specification, and their references, are incorporated by reference herein where appropriate for teachings of additional or alternative details, features, and/or technical background.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the decurler system of the present invention preferably for use in a conventional copier/printer. However, it should be understood that the sheet decurling method and apparatus of the present invention could be used with any machine environment in which decurling of sheets is desired.

In general, an improvement to prior sheet decurling systems of machines is disclosed which is cost effective, requires less space than previous decurler systems and comprises the use of a decurler with the capability of bending sheets in both directions (AI and TI) with equal latitude using tandem gates and bending baffles.

Figure 4:
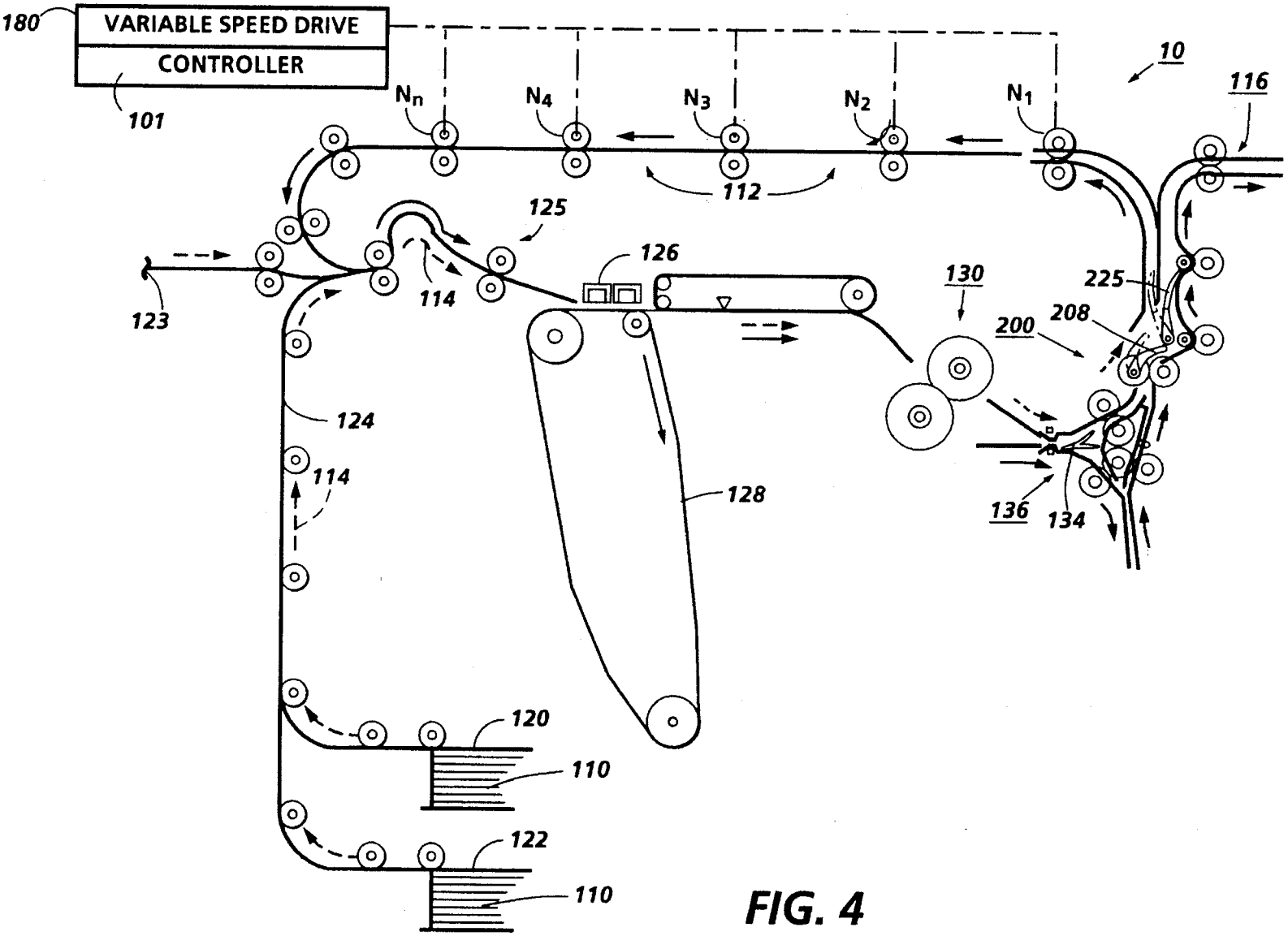
FIG. 4 is an elevational view illustrating schematically a variable speed endless loop duplex path incorporating the decurler of FIG. 1 therein, which is part of an exemplary duplex printer.

For a general understanding of the features of the present invention, reference is made to the drawings. In the drawings like reference numerals have been used throughout to designate identical elements. FIG. 4 schematically depicts the various components of an illustrative electrophotographic printing machine incorporating the decurling apparatus of the present invention therein. It will become evident from the following discussion that the decurling apparatus is equally well suited for use in a wide variety of printing machines and is not necessarily limited in its application to the particular embodiment shown herein. In addition, the location of the decurling apparatus, as depicted in the FIG. 4 electrophotographic printing machine, may be varied. The decurling apparatus may be positioned intermediate any of the processing stations within the printing machine. In the printing machine depicted in FIG. 4, the decurling apparatus is positioned after the fusing station prior to transport to a duplex path or an output or catch tray so as to straighten the final copy sheet prior to duplexing and/or removal from the printing machine by the operator. However, this location is merely illustrative of the operation of the decurling apparatus and may be varied.

Describing first in further detail the exemplary printer embodiment with reference to FIG. 4, there is shown a duplex laser printer 10 by way of example of automatic electrostatographic reproducing machines of a type like that of the existing commercial Xerox Corporation "DocuTech" printer shown and described in U.S. Pat. No. 5,095,342 suitable to utilize the decurling system of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed decurler system.

Turning now more specifically to this FIG. 4 system 10, the photoreceptor is 128, the clean sheets 110 are in paper trays 120 and 122 (with an optional high capacity input path 123), the vertical sheet input transport is 124, transfer is at 126, fusing at 130, inverting at 136 selected by gate 134, decurling at 200, etc. There is an overhead duplex loop path 112 with plural variable speed feeders $N_1$–$N_n$ providing the majority of the duplex path 112 length and providing the duplex path sheet feeding nips; all driven by a variable speed drive 180 controlled by the controller 101. This is a top transfer (face down) system. An additional gate 225 selects between output 116 and dedicated duplex return loop 112 here.

In this FIG. 4 embodiment, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 4, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or deflects the sheet into the duplex path 112, specifically, first into single sheet inverter 136 here. That is, if the sheet is either a simplex sheet, or a completed duplex sheet having both side one and side two images formed thereon, the sheet will be conveyed via gate 134 directly to output 116. However, if the sheet is being duplexed and is then only printed with a side one image, the gate 134 will be positioned by sensor 132 ( led emitter and receiver) and controller 101 to deflect that sheet into the inverter 136 of the duplex loop path 112, where that sheet will be inverted and then fed to sheet transports 124 and 125 for recirculation back through transfer station 126 and fuser 130 for receiving and permanently fixing the side two image to the backside of that duplex sheet, before it exits via exit path 116. All of the sheets pass through decurler 200.

Figure 1:
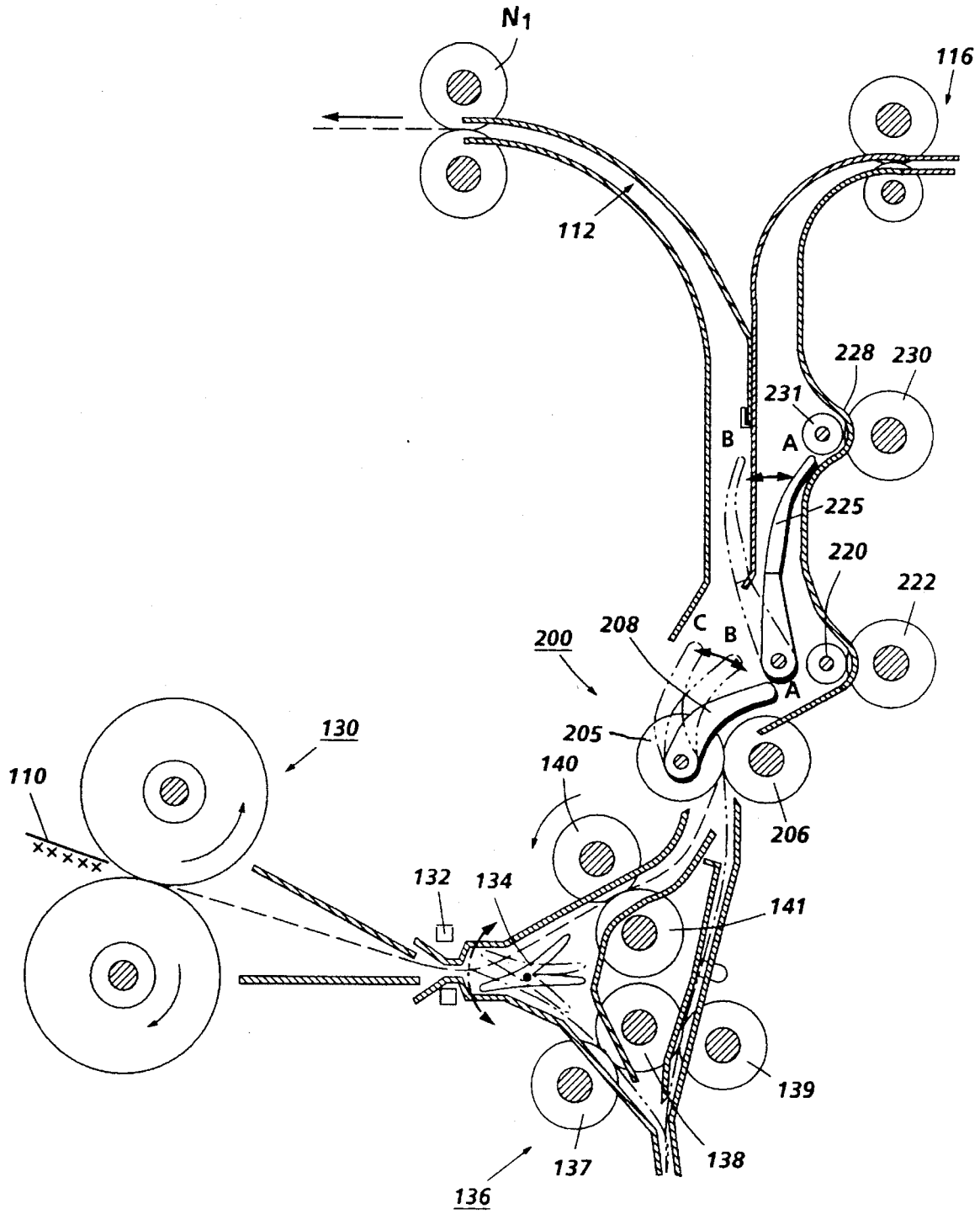
FIG. 1 is an elevational view showing the decurling apparatus of the present invention used in a variable speed endless loop duplex path, which is part of an exemplary duplexing printer.

Referring now to the subject matter of the present invention, FIG. 1 depicts an embodiment 200 of the decurler apparatus of the present invention in detail. The decurling apparatus 200 is under the control of controller 101 and has the capability of handling incoming sheets 110 from inverter 136 with a wide range of AI and TI curl by providing TI and AI bending with tandem solenoid controlled gates and optionally, adjustable baffles. Sheets 110 are driven into inverter 136 by drive roller 138 that mates with idler roller 137 and are driven out of the inverter by a nip formed between drive roller 138 and idler roller 139. Drive roller 141 and idler roller 140 convey non-inverted sheets into decurler 200. Decurling apparatus 200 features a shaft mounted idler roll 205 that forms a sheet driving nip with drive roll 206. A three-position curvilinear gate 208 is also mounted on the idler roll shaft and is adapted to be rotated on the shaft to either of the three positions to direct sheets to duplex loop 112 or toward exit path 116. Downstream of TI bending gate 208 is an AI bending baffle 228 that functions with nips formed between drive roll 222 and pinch shaft 220 and drive roll 230 and pinch shaft 231 to place away from image bending in the sheets. A two-position gate 225 is included downstream of gate 208 to direct sheets either into the duplex path 112 and variable speed feeder $N_1$ when it is positioned in position B or exit path 116 when it is in position A. When gate 208 is in position A sheets are given a slight toward image bend and directed toward AI bending baffle 228. If gate 208 is in position B, sheets are directed toward the machine exit at 116 with no bending. However, when gate 208 is in Position C, sheets are given AI bending by the inverter 136 only and directed toward duplex path 112.

Figure 2:
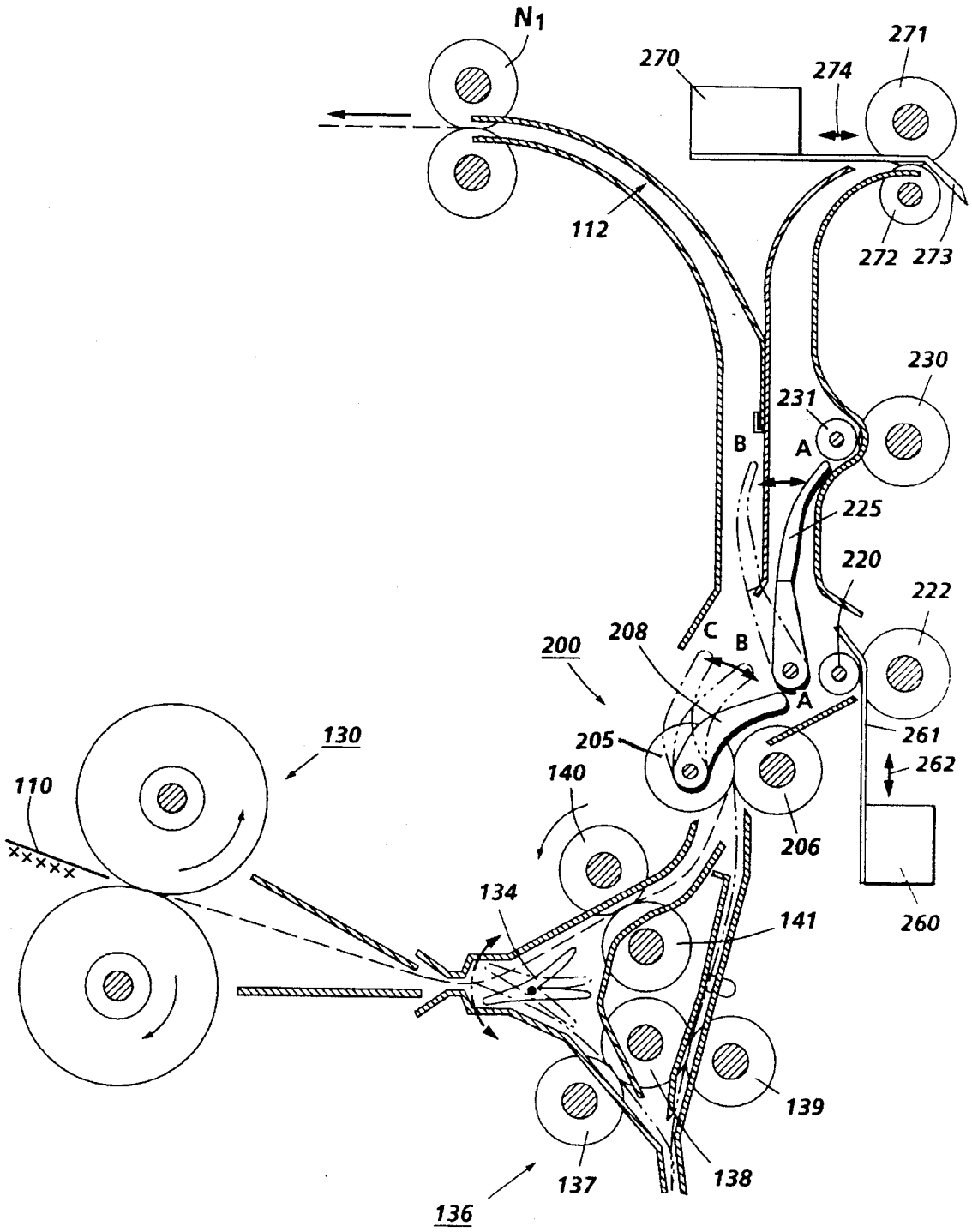
FIG. 2 is an elevational view showing a different embodiment of the decurling apparatus of the present invention that employs adjustable sheet bending baffles.

An alternative embodiment of the tandem gate decurler of the present invention is shown in FIG. 2 and includes two bending baffles 261 and 273. Bending baffle 261 is configured for away from image bending and bending baffle 273 is positioned for toward image with both binding baffles being controllable by a machine operator. Bending baffle 261 is reversibly movable in the direction of arrow 262 by solenoid 260 while bending baffle 273 is movable by solenoid 270 in the directions of arrow 274. Solenoids 260 and 270 are controlled by an operator using FIG. 3 push-buttons 303 and 304 on control panel 301 of console 300 to change output curls. The travel distance of the solenoids 260 and 270 change the gap between baffles 261 and 273 and the pinch shafts 220 and 272, respectively, in order to affect the output curls. This feature is useful for out-of-specification sheets or unusual conditions that are not included in the decurler control software.

Automatically determining the preferred positioning of gates 208 and 225 for an optimum decurling path is accomplished with a conventionally written software program that includes necessary sensor and system inputs, such as, use of conventional devices that determine paper basis weight, color mode (color layers on a sheet), image area coverage and, if needed, relatively humidity. For example, conventional paper basis weight sensors that can be used to input data to a computer are shown in U.S. Pat. Nos. 5,127,643 and 5,138,178. A toner area coverage sensor in the art of color densitometry is known from U.S. Pat. No. 4,989,985. This digital input on the area coverage is divided into low, medium and high levels as factors for determining the proper paper path for bendings. Color mode (number of color layers) input is conventionally translated into three levels of toner mass per unit area, such as, low, medium and high as factors in the control algorithm for determining the proper paper path for bendings. Digital signals from these sensors are sent to controller 101 which in turn, through preloaded historical data or a lookup table, determines the optimal setting of gate positions for minimizing output curl.

The decurling paths are defined by different combinations of the gate locations. Table 1 describes the matching of the types of incoming fused copies with their appropriate decurling paths.

TABLE 1

Tandem Decurler Gate Control

| | | |
|---|---|---|
| Path No. 1: | AI bend at inverter | |
| Duplex path | Gate 208 at Position C | |
| Path No. 2: | Gate 208 at Position B | Duplex copies |
| No bend | Gate 225 at Position A | Low toner mass per unit area (TMA) Low area coverage (AC) |
| Path No. 3: | Gate 208 at Position A | Medium TMA |
| TI and AI bends | Gate 225 at Position B | Medium AC |
| Path No. 4: | Gate 208 at Position A | High TMA |
| TI, AI and AI bends | Gate 225 at Position A | High AC |

As indicated, in subsystem operation with respect to a requirement for duplex copies in Path No. 1, after detecting the lead edge of the first side imaged sheet with lead edge sensor 132, the solenoid attached to gate 208 is energized to its full open position C and the solenoid connected to gate 225 is actuated to open to position B. Both gates remain open until the sheet is guided into the duplex path 112. After the sheets have been imaged on the second side, gate 225 may return to position A and gate 208 is stopped in position B, which forms path No. 2 for no further bending. Path No. 2 of table 1 is also for simplex copies when no bending is required by the control software of controller 101 based on sensor and system inputs. Gates normally stay at their home positions, which are position A for gate 225 and position A for gate 208 until a different sheet path is selected by the controller.

Path No. 3 is utilized when TI and AI bends for simplex copies are selected by the controller and gate 208 is moved to closed position A and gate 225 is moved to position B. The gates remain at the same positions until the controller selects a different sheet path. In Path No. 3, papers are driven in the nips of the drive rolls and a pinch shaft and are simultaneously bent in the AI direction while being forced to wrap around the pinch shaft 220 partially by a baffle having a segment of small bend-radius closely conforming to the pinch shaft. After AI bending take place, sheets exit the machine without passing through the bending nip formed between the pinch shaft 231 and the baffle 228. This path is suitable for medium toner mass per unit area (TMA) and medium image area coverage (AC). Paper path No. 4 applies two consecutive AI bendings following the initial moderate TI bending for heavily imaged color copies (high toner mass per unit area and high area coverage), which tend to curl toward the image if untreated. This additional bending produces the same result as would be obtained by increasing the wrapping angle to affect curl. Path No. 4 is defined by gate 208 at positions A and gate 225 at position A, which guides a sheet into the nip of pinch shaft 231 and bends the sheet in the AI direction by baffle 228.

Figure 3:
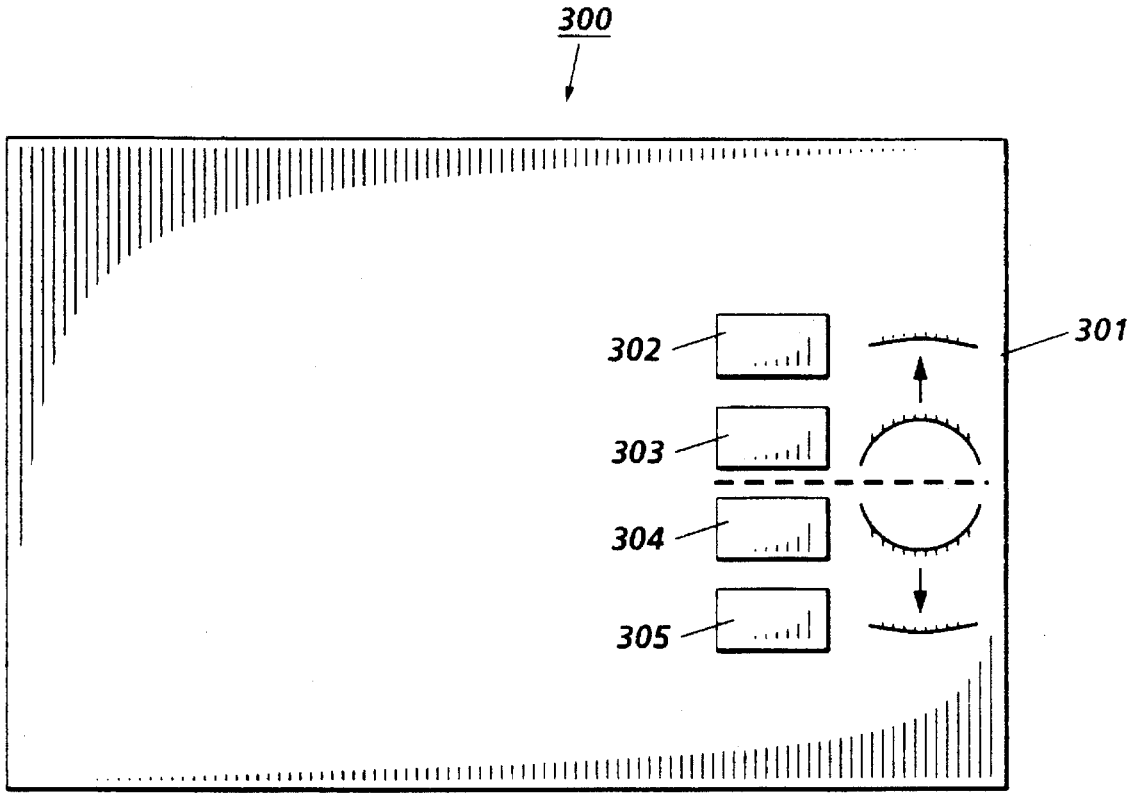
FIG. 3 is an elevational view showing an operator control panel for manipulating the decurling apparatus of the present invention for special sheets.

FIG. 2 shows the feature of adjustable bending baffles for controlling the bending level. Adjustable baffle 261 at the close position (narrow gap) is for more AI bending. Adjustable baffle 273 at the close position shown is for more TI bending. The baffle gaps are controlled by using solenoids 260 and 270, respectively, which are actuated by push buttons accessible to an operator as shown in FIG. 3. These features are useful for operators who use more two-sided, out-of-specification papers or who misplace the face-up (or arrow up) direction of a paper ream. In order to adjust for the aforementioned situations, button 303 can be pressed by an operator to move the baffle 273 more toward the pinch shaft 272 to cause more TI bending, or button 304 can be pressed to move baffle 261 more toward pinch shaft 220 to cause more AI bending. The logic of buttons 303 and 304 can be linked to the gate locations such that the proper paper path and adjustable baffle can be selected to reduce curl.

It is, therefore, evident that there has been provided in accordance with the present invention a tandem decurler apparatus for copiers/printers or the like which serves to reverse bend or decurl a sheet at process speed thereby fully satisfying the aims and advantages hereinbefore set forth. Fused copy sheets are directed into different paper paths for different degrees of AI or TI bending to reduce curl according to sensor or system inputs on the paper basis-weight, image area coverage and color mode (number of color layers). Conventionally written software programs are loaded with pre-tested data base information and algorithms that determine the optimal setting of gate positions for minimizing output curls. The mechanical bendings are produced by driving sheets through gaps between a small radius baffle and a pinch shaft.

While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A multi-gate tandem decurling apparatus for removing curl from sheets being transported in a printing machine, comprising: a first nip for forwarding sheets into said decurler apparatus in a predetermined direction; a first gate, means for moving said first gate to either one of three positions, and wherein movement of said first gate provides toward image bending to the sheets in one of said three positions and provides no bending to the sheets in the other two of said three positions; a second gate adapted to direct the sheets either to a duplexing path or an exit path of the machine; second and third nips downstream of said first nip for forwarding sheets through said decurler apparatus, said second and third nips each including a pinch shaft and a drive roll; and at least one bending baffle configured to cooperate with said second and third pinch shafts to provide away from image bending to the sheets as they pass through said second and third nips.

2. A multi-gate tandem decurling apparatus for removing curl from sheets being transported in a printing machine, comprising: a first nip for forwarding sheets into said decurler apparatus in a predetermined direction; a first gate adapted to be moved to either one of three positions, said first gate being adapted to provide toward image bending to the sheets in one of said three positions and to provide no bending to the sheets in the other two of said three positions; a second gate adapted to direct the sheets either to a duplexing path or an exit path of the machine; second and third nips downstream of said first nip for forwarding sheets through said decurler apparatus, said second and third nips each including a pinch shaft and a drive roll; and at least one bending baffle adapted to cooperate with said second and third pinch shafts to provide away from image bending to the sheets as they pass through said second and third nips, and wherein said at least one bending baffle is adjustable in said predetermined direction in order to control the degree of bending of sheets passing through said second and third nips.

3. The multi-gate tandem decurling apparatus of claim 2, including a controller and sensors for sensing the basis weight, color mode and image area coverage of the sheets and sending signals to said controller, and wherein said controller is adapted to automatically determine the preferred positioning of said first and second gates for an optimum decurling path in order to minimize curl in the sheets exiting the printing machine.

4. The multi-gate tandem decurling apparatus of claim 3, wherein said first and second gates have curvilinear sheet contacting surfaces.

5. The multi-gate tandem decurling apparatus of claim 4, wherein said second gate has front and back surfaces, and wherein sheets being forwarded for duplexing contact said back surface of said second gate and sheets being forwarded out of the machine contact said front surface of said second gate.

6. The multi-gate tandem decurling apparatus of claim 5, wherein said first nip includes a shaft with an idler roll mounted thereon and a drive roll, and wherein said first gate is mounted on said shaft.

7. A multi-gate tandem decurling apparatus for removing curl from sheets being transported in a printing machine, comprising: a first nip for forwarding sheets into said decurler apparatus in a predetermined direction; a first gate, means for moving said first gate to either one of three positions, and wherein movement of said first gate provides toward image bending to the sheets in one of said three positions and provides no bending to the sheets in the other two of said three positions; a second gate, means for moving said second gate so as to direct the sheets either to a duplexing path or an exit path of the machine; second, third and fourth nips downstream of said first nip for forwarding sheets through said decurler apparatus, said second, third and fourth nips each including a pinch shaft and a drive roll; and a plurality of bending baffles adapted to cooperate with said second and third and fourth pinch shafts to provide away from image bending to the sheets as they pass through said second and third nips and toward image bending to sheets as they pass through said fourth nip.

8. A multi-gate tandem decurling apparatus for removing curl from sheets being transported in a printing machine, comprising: a first nip for forwarding sheets into said decurler apparatus in a predetermined direction; a first gate adapted to be moved to either one of three positions, said first gate being adapted to provide toward image bending to the sheets in one of said three positions and to provide no bending to the sheets in the other two of said three positions; a second gate adapted to direct the sheets either to a duplexing path or an exit path of the machine; second, third and fourth nips downstream of said first nip for forwarding sheets through said decurler apparatus, said second, third and fourth nips each including a pinch shaft and a drive roll; and a plurality of bending baffles adapted to cooperate with said second and third and fourth pinch shafts to provide away from image bending to the sheets as they pass through said second and third nips and toward image bending to sheets as they pass through said fourth nip, and wherein at least two of said plurality of bending baffles are adjustable in said predetermined direction in order to vary the amount of bending placed into the sheets.

9. The multi-gate tandem decurling apparatus of claim 8, wherein said at least two bending baffles are each connected to a separate, actuatable solenoid.

10. The multi-gate tandem decurling apparatus of claim 9, wherein said separate, actuatable solenoids are controlled by a machine operator in accordance with predetermined sheet parameters.

11. A printing machine adapted to produce copies on sheets fed through a plurality of processing stations in the machine including a fuser, the machine having a sheet decurler apparatus for removing curl in the sheets after they have left the fuser, said sheet decurler apparatus comprising:

a first nip for forwarding sheets into said decurler apparatus in a predetermined direction;

a first gate, means for moving said first gate to either one of three positions, and wherein said movement of said first gate provides toward image bending to the sheets in one of said three positions and provides no bending to the sheets in the other two of said three positions;

a second gate, means for moving said second gate so as to direct the sheets either to a duplexing path or an exit path of the printing machine;

second and third nips downstream of said first nip for forwarding sheets through said decurler apparatus, said second and third nips each including a pinch shaft and a drive roll;

and at least one bending baffle configured to cooperate with said second and third pinch shafts to provide away from image bending to the sheets as they pass through said second and third nips.

12. A printing machine adapted to produce copies on sheets fed through a plurality of processing stations in the machine including a fuser, the machine having a sheet decurler apparatus for removing curl in the sheets after they have left the fuser, said sheet decurler apparatus comprising:

a first nip for forwarding sheets into said decurler apparatus in a predetermined direction;

a first gate adapted to be moved to either one of three positions, said first gate being adapted to provide toward image bending to the sheets in one of said three positions and to provide no bending to the sheets in the other two of said three positions;

a second gate adapted to direct the sheets either to a duplexing path or an exit path of the printing machine;

second and third nips downstream of said first nip for forwarding sheets through said decurler apparatus, said second and third nips each including a pinch shaft and a drive roll;

and at least one bending baffle adapted to cooperate with said second and third pinch shafts to provide away from image bending to the sheets as they pass through said second and third nips, and wherein said at least one bending baffle is adjustable in said predetermined direction in order to control the degree of bending of sheets passing through said second and third nips.

13. The printing machine of claim 12, including a controller and sensors for sensing the basis weight, color mode and image area coverage of the sheets and sending signals to said controller, and wherein said controller is adapted to automatically determine the preferred positioning of said first and second gates for an optimum decurling path in order to minimize curl in the sheets exiting the printing machine.

14. The printing machine of claim 13, wherein said first and second gates have curvilinear sheet contacting surfaces.

* * * * *